US008009855B2

(12) United States Patent
Chiba

(10) Patent No.: US 8,009,855 B2
(45) Date of Patent: Aug. 30, 2011

(54) SPEAKER

(75) Inventor: Satoshi Chiba, Tendo (JP)

(73) Assignee: Tohoku Pioneer Corporation, Yamagata (JP)

( * ) Notice: Subject to any disclaimer, the term of this patent is extended or adjusted under 35 U.S.C. 154(b) by 1132 days.

(21) Appl. No.: 11/805,795

(22) Filed: May 24, 2007

(65) Prior Publication Data

US 2007/0274557 A1 Nov. 29, 2007

(30) Foreign Application Priority Data

May 29, 2006 (JP) ..... 2006-147972

(51) Int. Cl.
*H04R 1/00* (2006.01)
*H04R 9/06* (2006.01)
*H04R 11/02* (2006.01)

(52) U.S. Cl. ..... 381/396; 381/412

(58) Field of Classification Search ..... 381/396, 381/400, 412, 386, 394, 150; 181/171, 157, 181/161

See application file for complete search history.

(56) References Cited

U.S. PATENT DOCUMENTS

| | | | | |
|---|---|---|---|---|
| 6,072,887 | A * | 6/2000 | Wei | 381/412 |
| 6,154,556 | A * | 11/2000 | Takahashi et al. | 381/430 |
| 2003/0059079 | A1 * | 3/2003 | Asahina et al. | 381/396 |

FOREIGN PATENT DOCUMENTS

| | | | |
|---|---|---|---|
| JP | 2003-134585 | | 9/2003 |
| JP | 2005/260771 | A | 9/2005 |
| WO | 02/34005 | A2 | 4/2002 |
| WO | 2006/001228 | A | 1/2006 |

* cited by examiner

*Primary Examiner* — Tuan Nguyen
(74) *Attorney, Agent, or Firm* — Ladas & Parry, LLP

(57) ABSTRACT

A degree of freedom in designing a circuit board to which a speaker is attached is enhanced. The speaker including: a frame with a yoke of a magnetic circuit portion embedded inside a central through hole; a diaphragm having a voice coil inserted in a magnetic circuit of the magnetic circuit portion; a cap having a sound dispersing hole that covers over the diaphragm and the frame; and a terminal electrically connected to the voice coil on a side opposite to the cap of the frame, wherein an insulating body is attached to an exposing portion of the yoke on the side opposite to the cap, a back pressure adjusting hole is provided in the exposing portion with respect to the diaphragm, and the terminals are provided to be retractable in the back pressure adjusting hole.

6 Claims, 13 Drawing Sheets

SPEAKER

BACKGROUND OF THE INVENTION

1. Field of the Invention

The present invention relates to a technical field of a speaker used by, for example, a small-sized electronic apparatus.

2. Related Art

One type of the speaker used for small-sized electronic apparatuses disclosed in Japanese Unexamined Patent Publication 2003-134585 is typically constructed to include a frame which holds an magnetic circuit portion in its center, a diaphragm which is equipped with a voice coil accommodated inside a magnetic circuit of the magnetic circuit portion, and a cap which has a sound dispersing hole, wherein the speaker is configured to sequentially overlap the diaphragm and the cap on the frame and connect these to the frame.

However, there is a problem that a degree of freedom is limited in designing a circuit board since the conductive pattern, being an electrically transmitting portion of the circuit board, is inevitably provided so as not to come below the yoke since a speaker is ordinarily arranged at a position apart from the yoke in order to avoid the terminal from being in contact with the yoke.

SUMMARY OF THE INVENTION

It is therefore an object of an illustrative, non-limiting embodiment of the present invention to enhance the degree of freedom in designing the circuit board by relaxing restriction imposed to arrangement of the speaker on a circuit board. Further, another object is to achieve compactness of speaker and reduction of mounting space by accommodating terminals below a yoke.

According to an aspect of an illustrative, non-limiting embodiment of the present invention, there is provided a speaker that is configured to cover a frame, which has a yoke of a magnetic circuit portion embedded inside a through hole in a center of the frame, with a diaphragm having a voice coil to be inserted inside a magnetic circuit of the magnetic circuit portion, and cover the frame with a cap having a sound dispersing hole over the diaphragm and on the frame, and to provide a terminal for electrically connecting to the voice coil on a side opposite to the cap of the frame, wherein an insulating body is attached to an exposing portion on a side opposite to the cap of the yoke, a back pressure adjusting hole for the diaphragm is formed in the exposing portion, and the terminal is provided to be able to enter into the back pressure adjusting hole.

DESCRIPTION OF THE PREFERRED EMBODIMENTS

Figure 1:
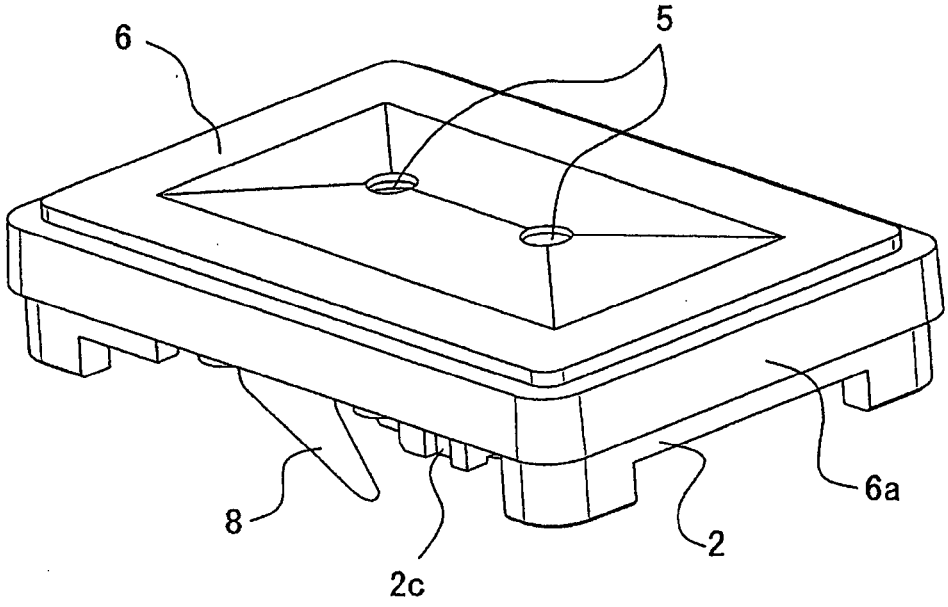
FIG. 1 is a perspective view for showing a speaker according to Embodiment 1 of the present invention on a side of cap.

Preferred embodiments of the present invention will be described in conjunction with figures. Hereinafter, each designation of numerical references in the figures is typically as follows:

1: magnetic circuit portion; 2: frame; 3: voice coil; 4: diaphragm; 5: Sound dispersion hole; 6: cap; 7: through hole; 8: terminal; 9: yoke; 9*a*: protruding wall; 13 insulating body; and 14: back pressure adjusting hole.

Embodiment 1

As shown in FIGS. 1 to 5, the speaker has a frame 2 which holds a magnetic circuit portion 1 in a center thereof, a diaphragm 4 which has a voice coil 3 inserted inside a magnetic circuit of the magnetic circuit portion 1, and a cap 6 having a sound dispersion hole 5. The speaker is assembled by sequentially covering the diaphragm 4 and the cap 6 over and over the frame 2, and a periphery of the speaker is enclosed by a peripheral wall.

The peripheral wall is an overlapped wall made up of a standing wall 2*a* around the frame 2 and a rim wall 6*a* around the cap 6 covering an outer side of the standing wall 2*a*. The cap 6 is fixed to the frame 2 by connecting the rim wall 6*a* with the standing wall 2*a* by means of an appropriate connecting means of bonding, caulking, engaging or the like with a bond or a double-faced adhesive tape.

The frame 2 is shaped like a plate having a substantially rectangular outline, for example, by injection molding of synthetic resin. It is also possible to adopt desirable outline shapes such as circle, rectangular with its corners rounded, ellipse, and square, other than the rectangle. The standing wall 2*a* stands up from a periphery of the frame 2, and a through hole 7 is formed to extend in a longitudinal direction of the frame 2 and penetrate in a thickness direction of the frame 2 in a center of the frame 2. Although the through hole 7 is in a shape of rectangular with its corners rounded in the figure, it may have an arbitrary shape such as circle, rectangular, and square other than circle.

On a back side of the frame 2, there is provided a protrusion 2*b*, and a pair of terminals 8, made from a material for spring and fixed to a back side of the frame 2 using the protrusions 2*b*. Further, a recessed groove 2*c* is formed so as to respectively correspond to each of the terminals 8 on side surfaces of the standing walls 2*a*. The recessed groove 2*c* is provided to make a lead wire, described below, pass therethrough.

The pair of terminals 8 are engaged with the protrusions 2*b* and fixed to the back surface of the frame 2 while elongated base portions 8*a* are respectively located along longer side lines of the back surface of the frame 2. The terminals 8 protrude from each of the base portions 8*a* downward with respect to the back surface of frame 2.

The magnetic circuit portion 1 has the yoke 9, the magnet 10, and the plate 11, and is assembled by sequentially overlapping the magnet on the yoke 9, and the plate 11 on the magnet 10. By inserting the yoke 9 inside the through hole 7 of the frame 2 from the back surface side of the frame 2, the magnetic circuit portion 1 is assembled and fixed inside the frame 2.

The yoke 9 has a bottom plate 9*b* which overlaps the through hole 7 of the frame 2 on the side opposite to the cap 6 and a protruding wall 9*a* inserted inside the through hole 7 of the frame 2 and fixed thereto. A periphery of the plate 11 is opposed to the protruding wall 9*a* interposing a groove there between. By this, the magnetic circuit is formed by the magnet 10, the yoke 9 and the plate 11, wherein magnetic field lines traverse the groove between the protruding wall 9*b* and the periphery of the plate 11.

The bottom plate 9*b* of the yoke 9 is exposed to an outside of the through hole 7 as an exposing portion on a side opposite to the cap 6. The insulating body 13 is attached to the exposing portion. The insulating body 13 may be formed by adhering an insulating film, made from for example a synthetic resin, to a surface of the bottom plate 9*b* or by coating the surface with an insulating paint.

The diaphragm 4 is formed like a thin film of a resin film or the like. The diaphragm 4 is placed on the frame 2 so as to cover the magnetic circuit portion 1 and fixed to the frame 2 by for example a bond so that peripheral portion of the diaphragm is arranged to an inside of the standing wall 2*a* of the frame. Further, in a center of the diaphragm 4, a narrow groove is formed to intrude into a groove of the magnetic circuit portion 1. Inside the narrow groove, the voice coil 3 is embedded. As such, the voice coil 3 is held inside a magnetic circuit of the magnetic circuit portion 1. Two lead wires (not shown) are lead out of the voice coil 3 and electrically connected to each of the bases 8*a* of terminals 8. When a sound signal current is applied to the voice coil 3, the diaphragm 4 vibrates on the frame to disperse sound.

The cap 6 is shaped like a plate having an outline of rectangle similar to the frame 2 by for example press-molding of metallic plate. The rim wall 6*a* drops from a periphery of the cap 6. Further, in a center portion of the cap 6, sound dispersing holes 5 are located at a plurality of positions. Of course, the sound dispersing hole may be located at a single position. The rim wall 6*a* and the sound dispersing holes 5 are preferably formed when the cap 6 is press-molded. The cap 6 is covers the diaphragm and further the frame 2. At this time, the cap 6 is positioned so that an edge of the standing wall 2*a* is in contact with an inside of the standing wall 2*a*. The cap 6 and the frame 2 are fixed so as not to separate each other by an appropriate connecting means such as a double-faced adhesive tape.

Figure 5:
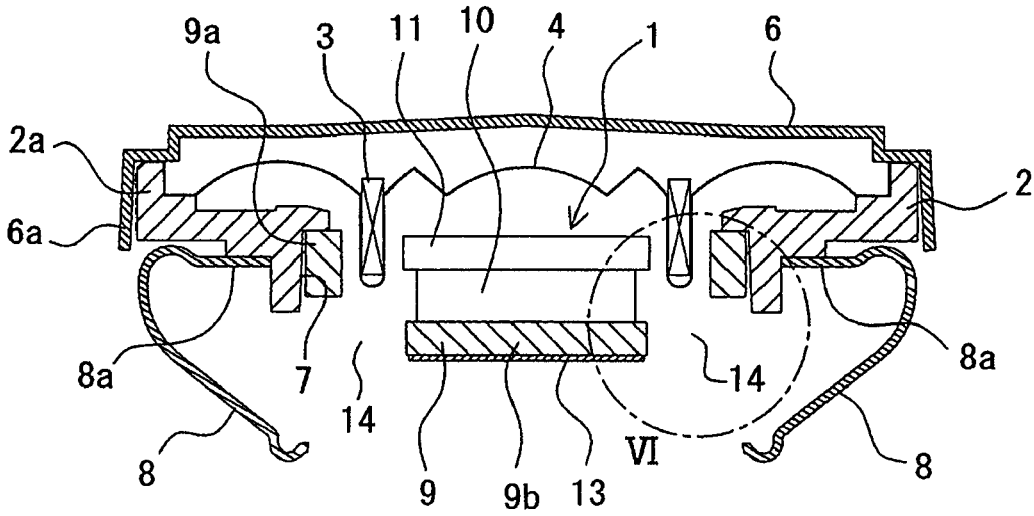
FIG. 5 is a cross-sectional view taken along a line V-V and viewed along arrows in FIG. 3.
Figure 6:
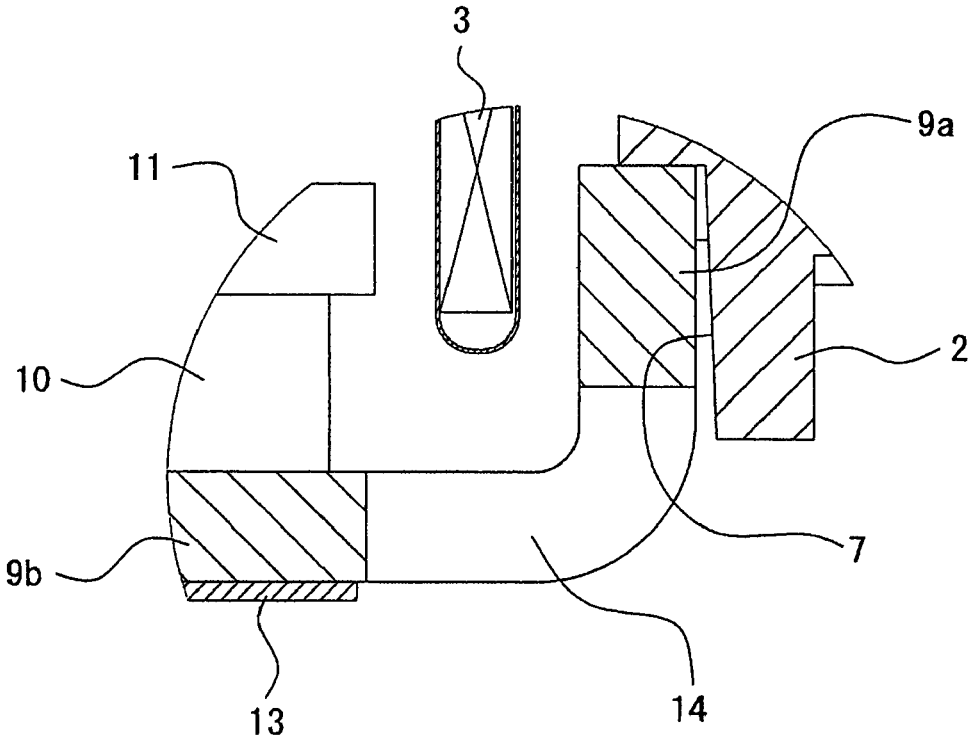
FIG. 6 is an enlarged view of a portion VI in FIG. 5.

As shown in FIGS. 5 and 6, the speaker is configured to have a back pressure adjusting hole 14 for the diaphragm 4 in the yoke 9. The back pressure adjusting hole 14 may be provided at any place as long as the back side of the diaphragm 4 is connected to an outside of the frame 2 so as to be ventilated. It is desirable to form the back pressure adjusting hole 14 in a base plate 9*b* exposing outside from the frame 2. By thus providing the back pressure adjusting hole 14, the back side of the diaphragm 4 is open to atmosphere outside the frame 2 through the back pressure adjusting hole 14 thereby enabling appropriate vibration of the diaphragm 4.

Figure 2:
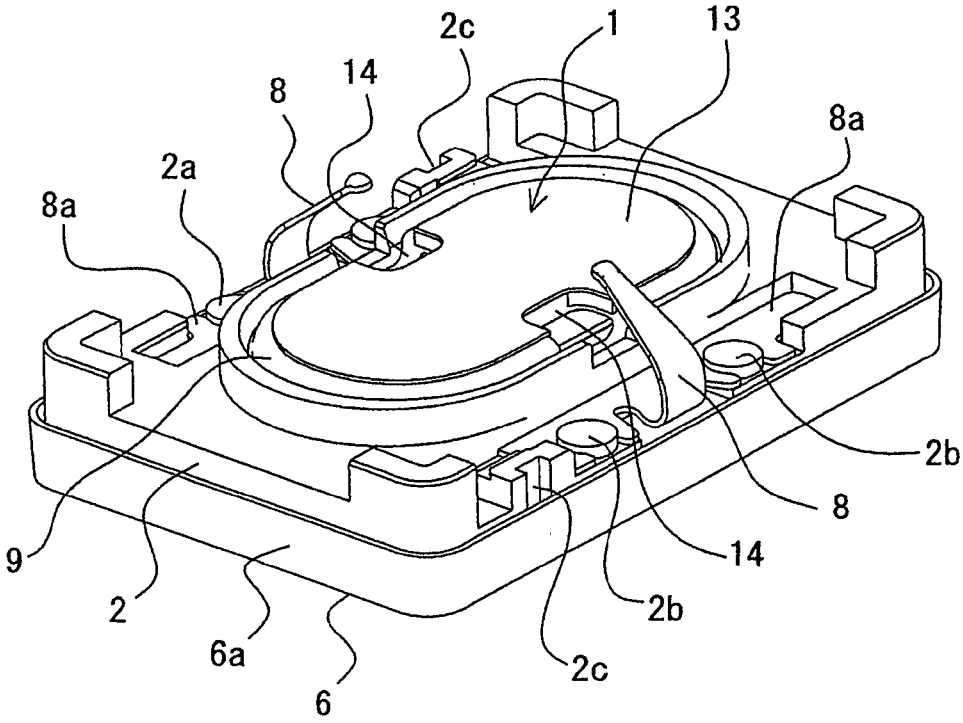
FIG. 2 is a perspective view for showing the speaker in FIG. 1 on a side of yoke.
Figure 3:
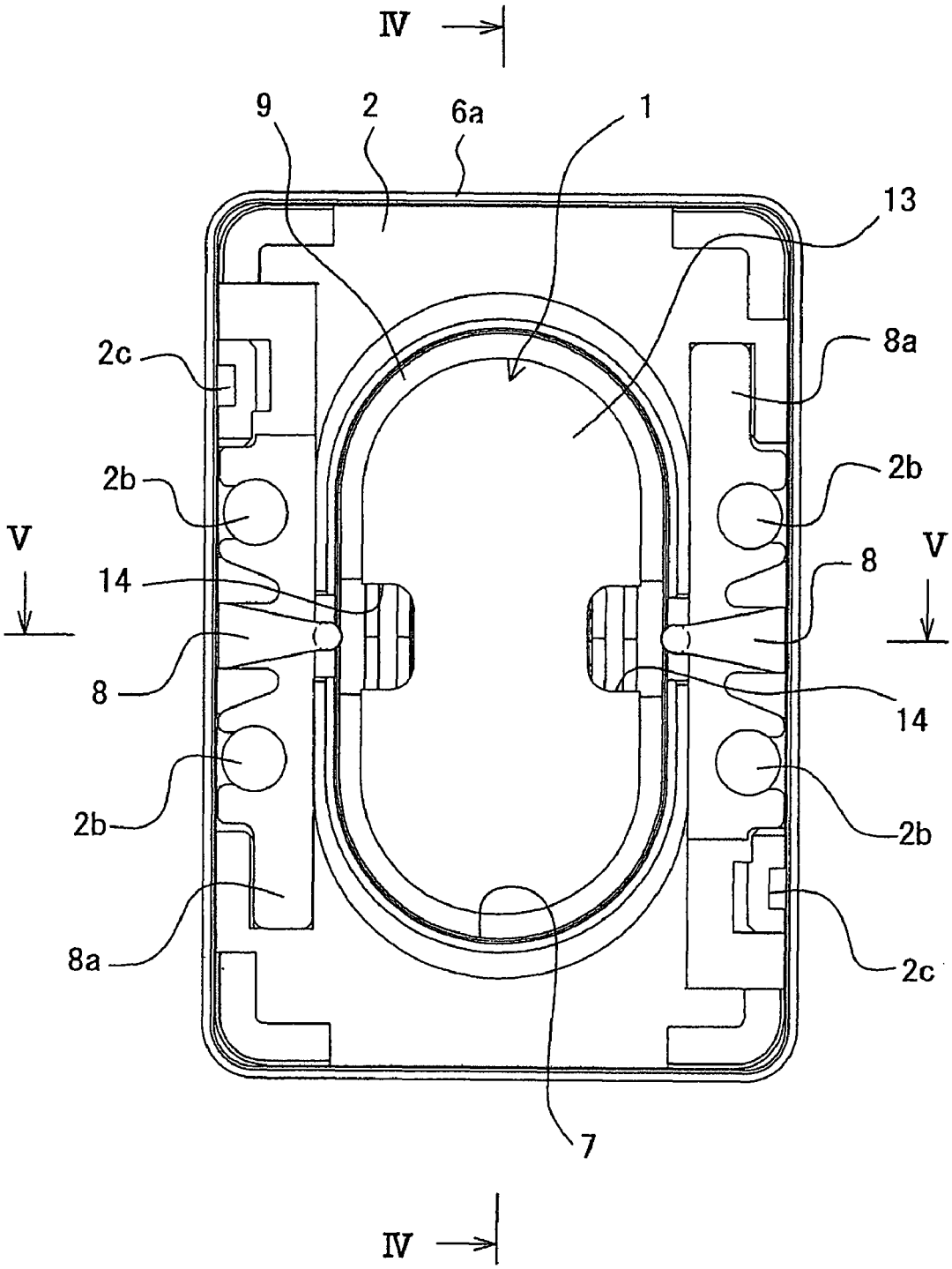
FIG. 3 is a bottom view of the speaker shown in FIG. 1 and 2.
Figure 4:
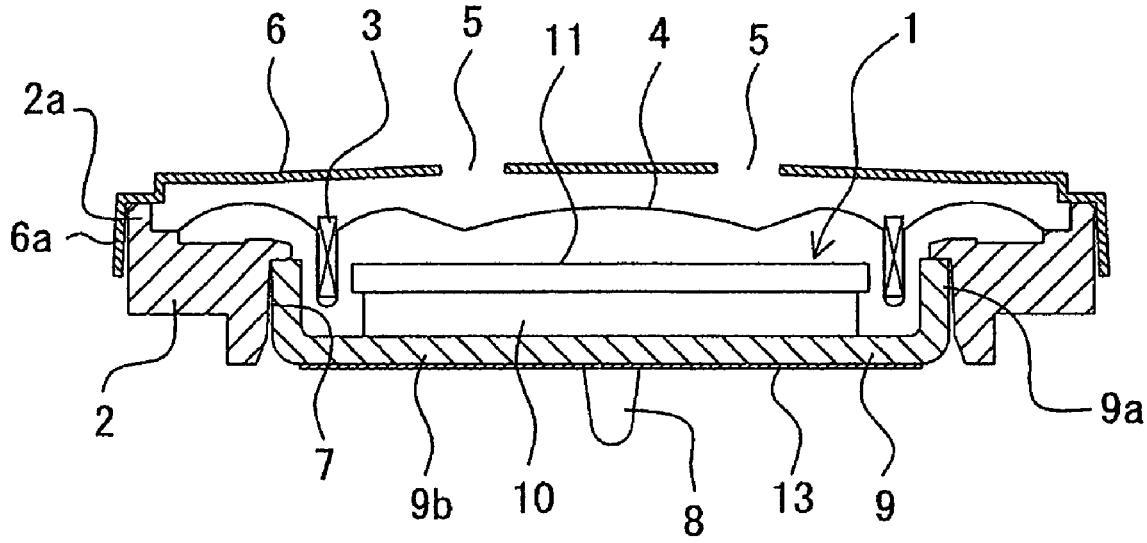
FIG. 4 is a cross-sectional view taken along a line IV-IV and viewed along arrows in FIG. 3.

As shown in FIGS. 2 and 3, the back pressure adjusting hole 14 is formed on a minor axis side of the yoke 9, desired to have a shape of rectangular with its corners rounded. By this, magnetic flux is uniformed along an entire periphery of the magnetic circuit in the magnetic circuit portion 1 thereby enabling appropriate vibration of the diaphragm 4.

Figure 7:
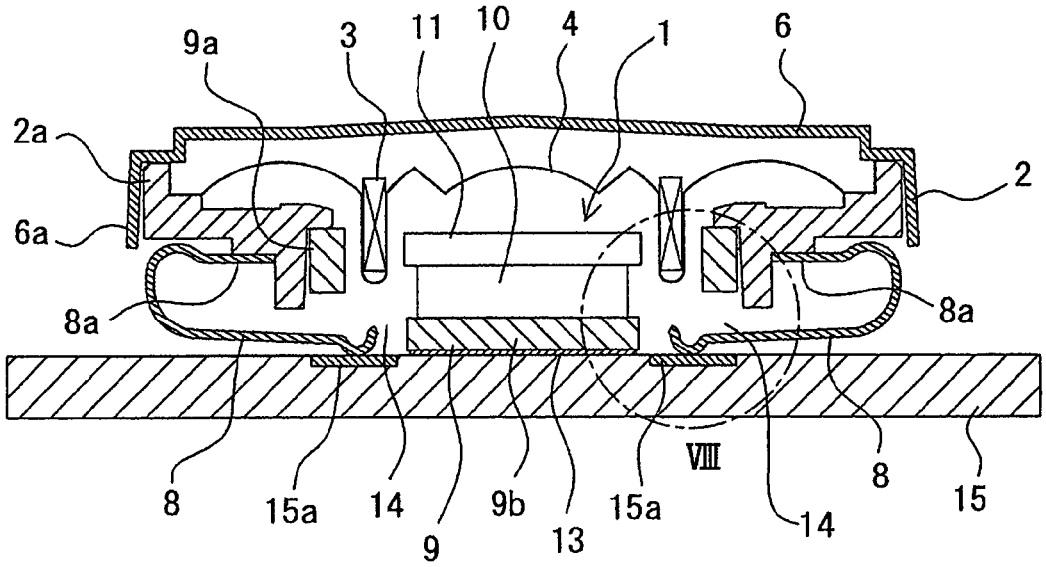
FIG. 7 is a cross-sectional view showing a state that a speaker according to Embodiment 1 is attached to a circuit board in correspondence with FIG. 5.
Figure 8:
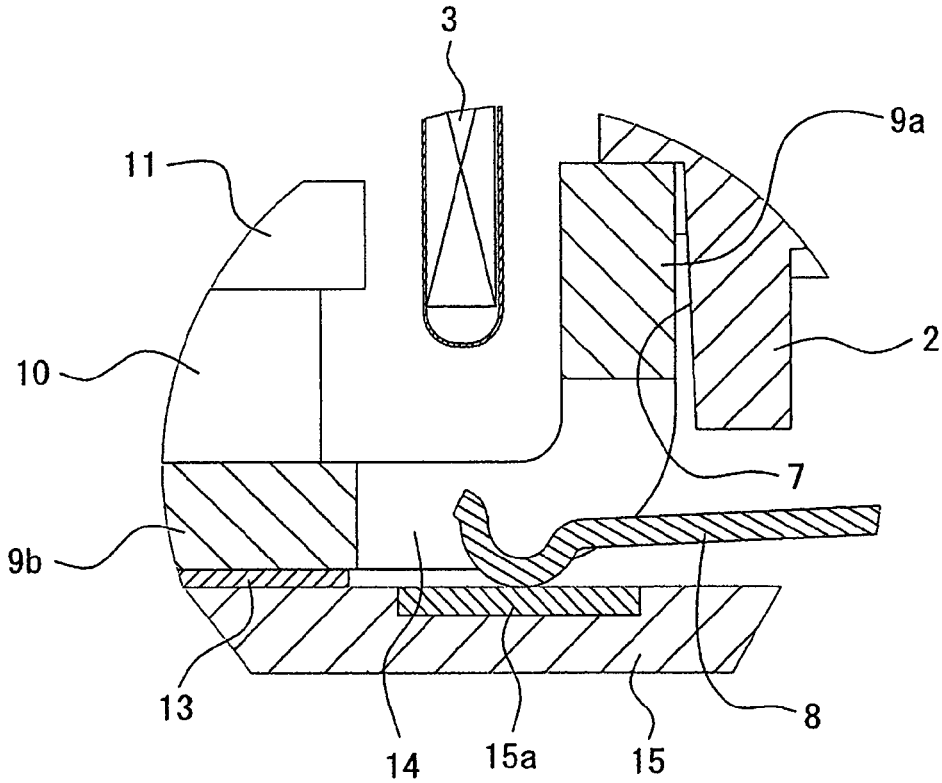
FIG. 8 is an enlarged view of a portion VIII in FIG. 7.

Furthermore, the back pressure adjusting hole 14 is formed to bridge the base plate 9*b* of the yoke 9 and the protruding wall 9*a*. Further, as shown in FIGS. 7 and 8, the terminal 8 is formed to retract in the base plate 9*b* of the yoke 9 and the protruding wall 9*a*. By this, when the speaker with its terminal 8 in an open state is fixed on a circuit board 15 of a small electronic apparatus as shown in FIG. 7, the terminal 8 is in contact with conductive pattern 15*a*, being an electric conductive portion of the circuit board 15. Then the terminal 8 is subjected to elastic deformation and is retracted in the back pressure adjusting hole 14. At this time, the bottom plate 9*b* of the yoke 9 is in contact with the circuit board 15 through the insulating body 13.

Figure 10A:
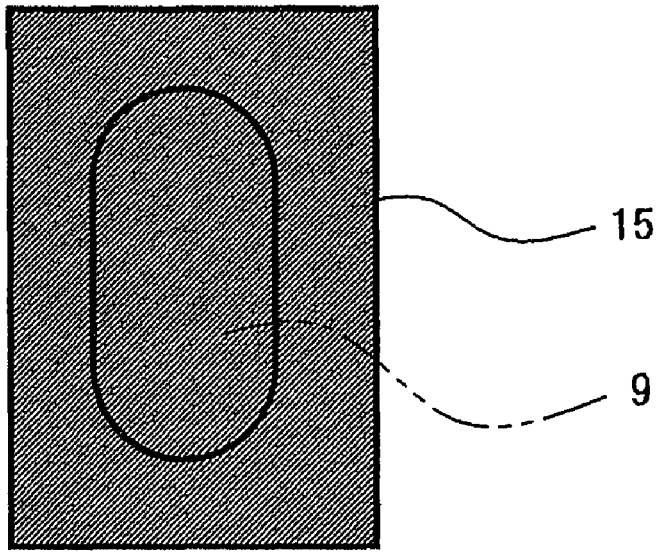
FIG. 10 is a view for showing a positional relationship between the yoke of speaker and the circuit board, wherein FIG. 10A corresponds to the present invention and FIG. 10B corresponds to a conventional technique.
Figure 10B:
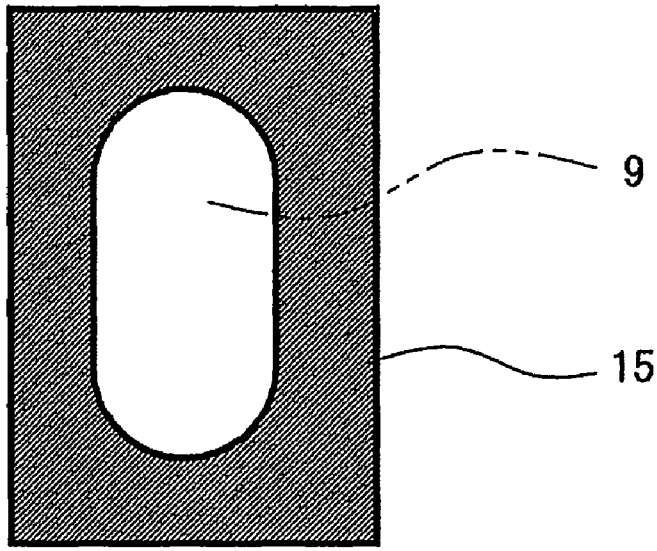

Namely, since in the conventional speaker, the terminal is arranged at a position apart from the yoke so that the terminal is not in contact with the yoke, the conductive pattern 15*a*, being the electric conductive portion of the circuit board 15, should be designed so as not to positioned below the yoke to avoid contact between the terminal and the yoke. Accordingly, a portion where the conductive pattern 15*a* is arranged is limited to a portion shown by shaded area in FIG. 10B, corresponding to other than the yoke. On the contrary thereto, the insulating body 13 is attached to the bottom plate 9*b* of the yoke 9 in the speaker according to Embodiment 1. Further, the terminal 8 is retracted in the back pressure adjusting hole 14 which is provided in from the bottom plate 9*b* of the yoke 9 to the protruding wall 9*a* and has a notched shape. Therefore, the conductive pattern 15*a* can be arranged at a desirable position substantially through an entire surface of the circuit substrate 15 as shown by shaded area in FIG. 10A. Thus a degree of freedom in designing the circuit board 15 is extremely improved.

Figure 9:
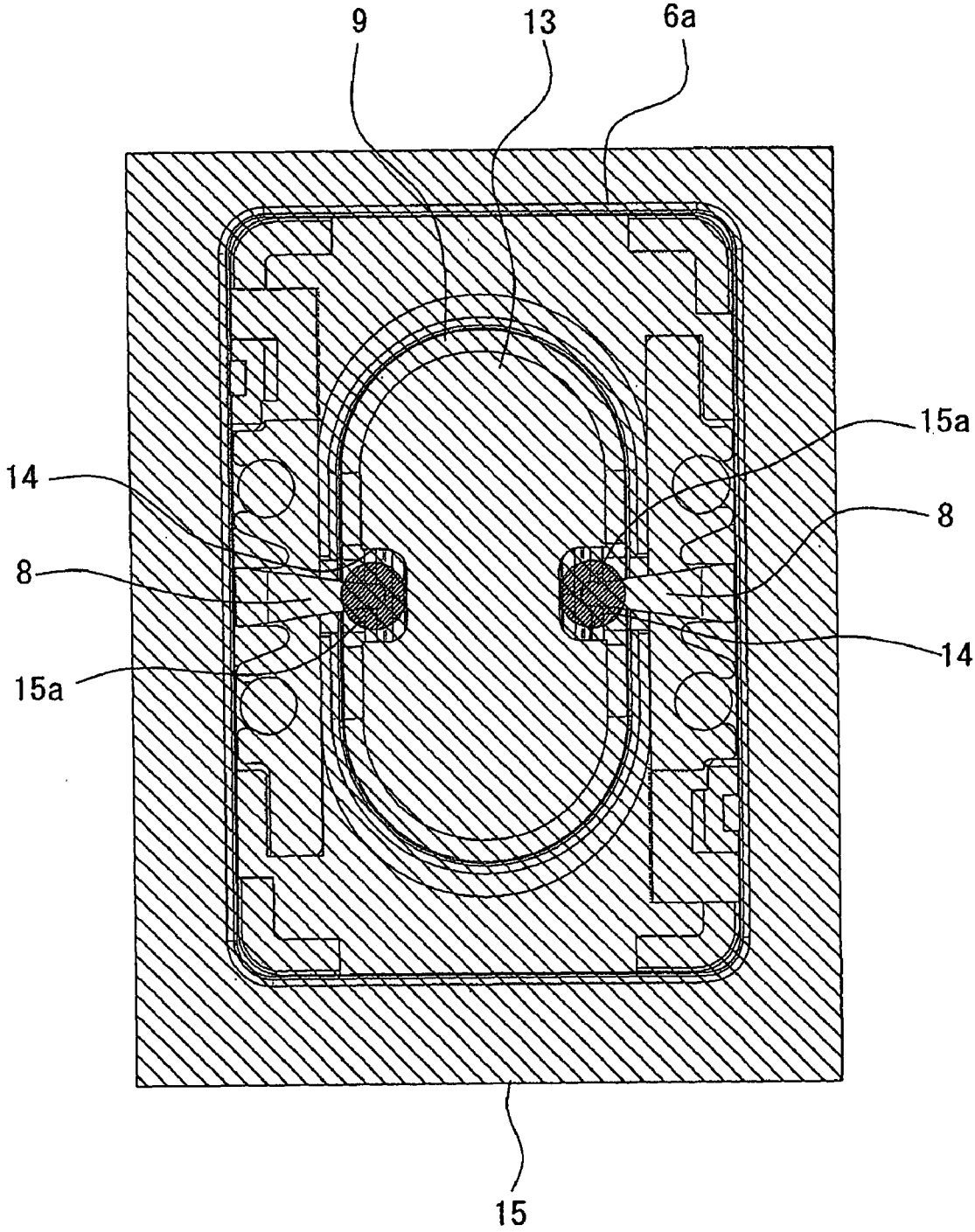
FIG. 9 is a view for showing a positional relationship between the speaker and the circuit board according to Embodiment 1.

Next, function of the speaker thus constructed will be described. As shown in FIGS. 7 to 9, the speaker is arranged on and fixed to the circuit board 15 so that the terminals 8 are in contact with the conductive pattern 15*a* of the circuit board 15. At that time, the terminals 8 of speaker are elastically bent and deformed to be retracted in the back pressure adjusting hole 14. Namely, the terminals 8 of speaker can be in contact with the conductive pattern 15*a* which is provided just beneath the yoke 9.

After the speaker is assembled to the circuit board 15, sound signal current is applied to the voice coil 3 from the circuit board 15 through the terminal 8, the diaphragm 4 vibrates on the magnetic circuit portion 1, and sound is dispersed outside from the sound dispersing hole 5 of the cap 6.

Embodiment 2

Figure 11:
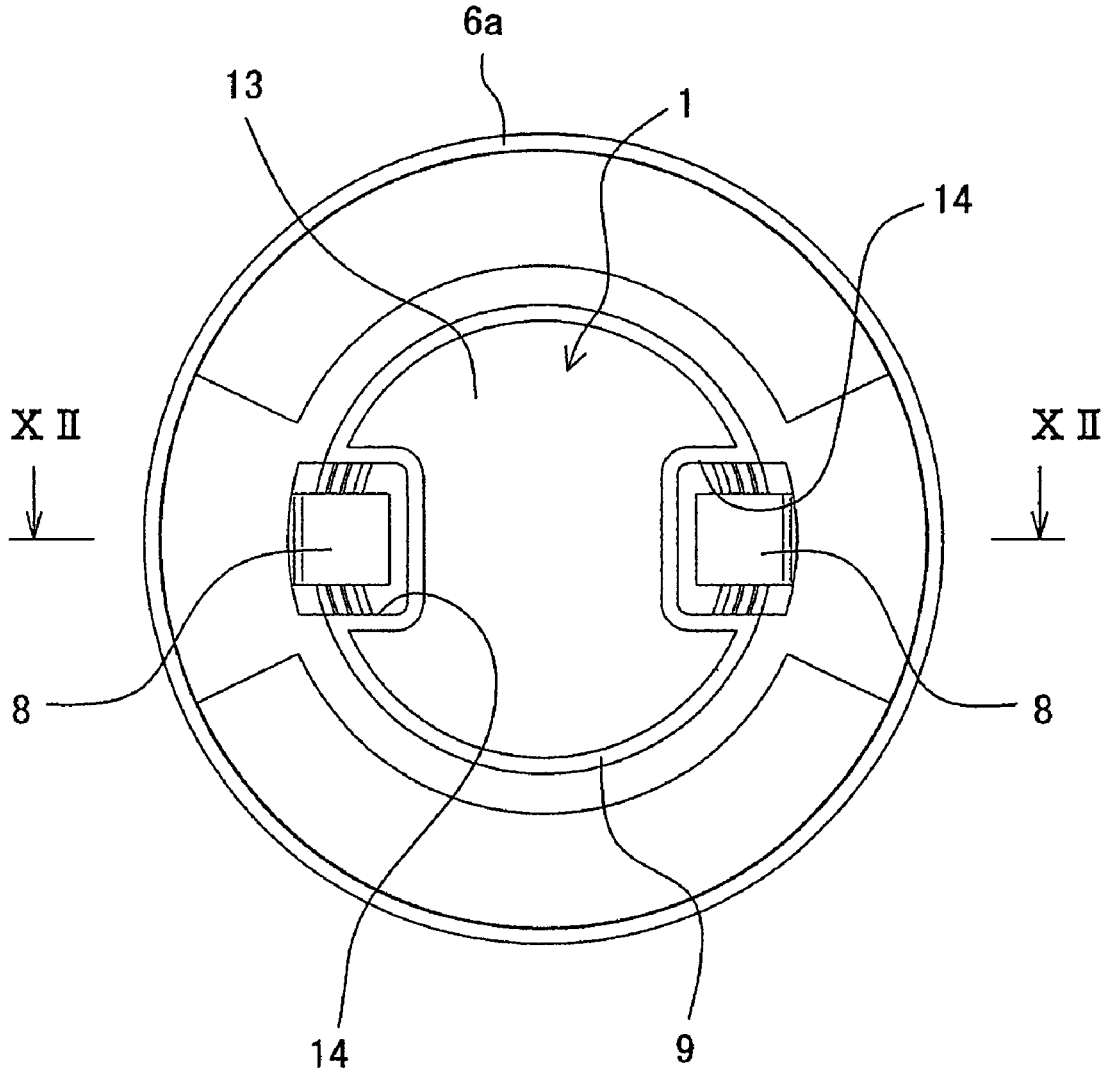
FIG. 11 is a perspective view for showing a speaker according to Embodiment 2 on a side of yoke.
Figure 12:
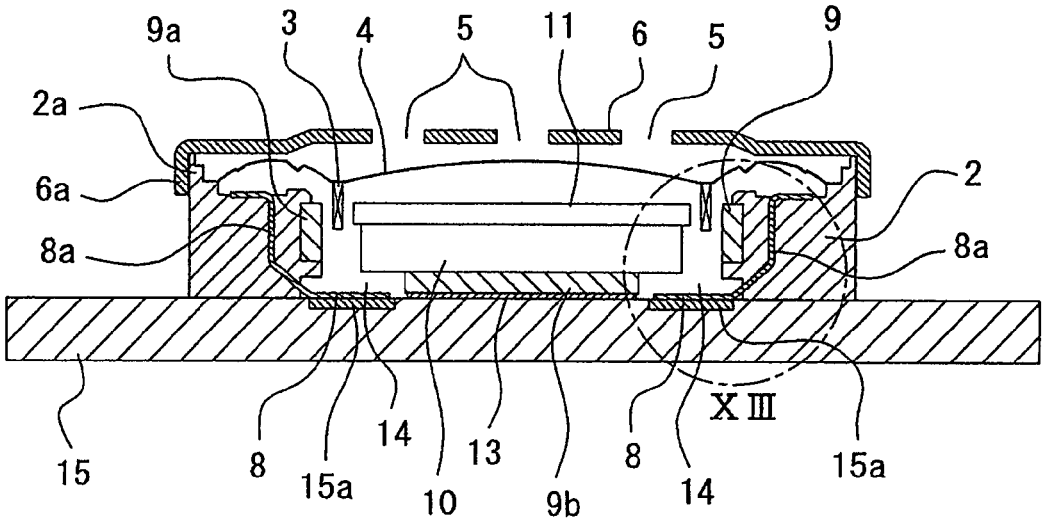
FIG. 12 is a cross-sectional view taken along a line and viewed along arrows XII-XII in FIG. 11.
Figure 13:
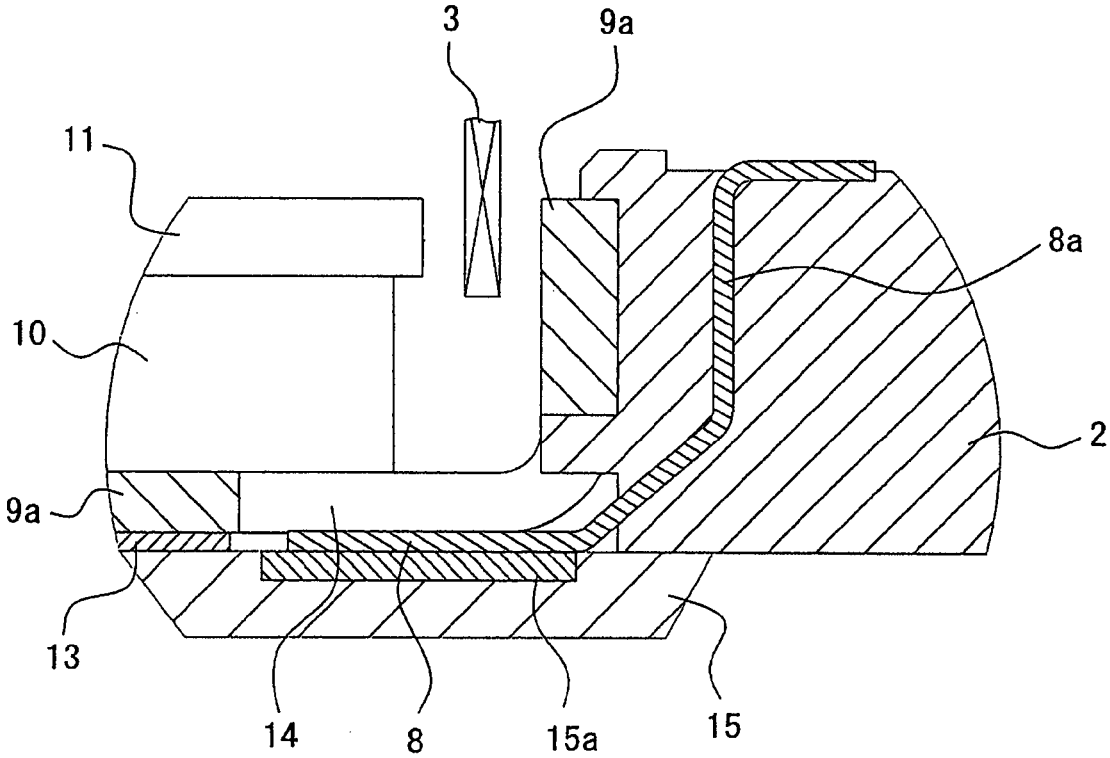
FIG. 13 is an enlarged view of a portion XIII in FIG. 12.
Figure 14:
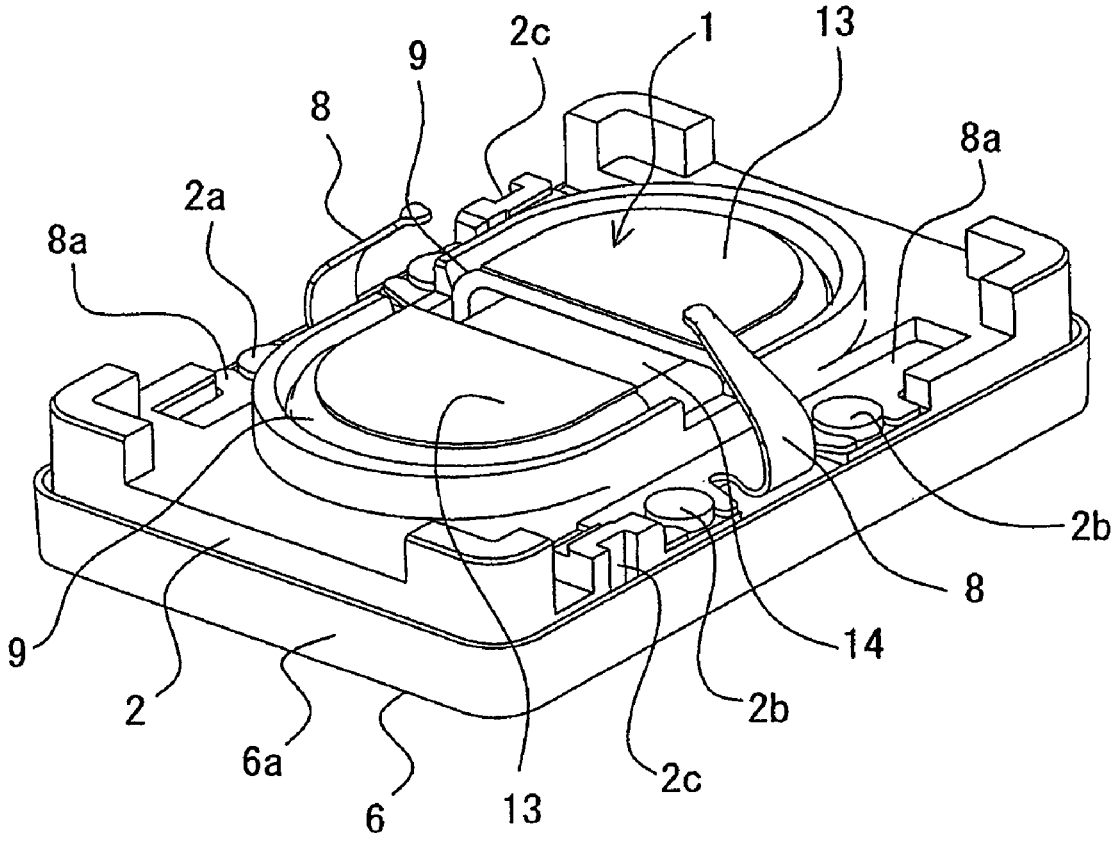
FIG. 14 is a perspective view showing the speaker according to Embodiment 3 on a side of yoke.
Figure 15:
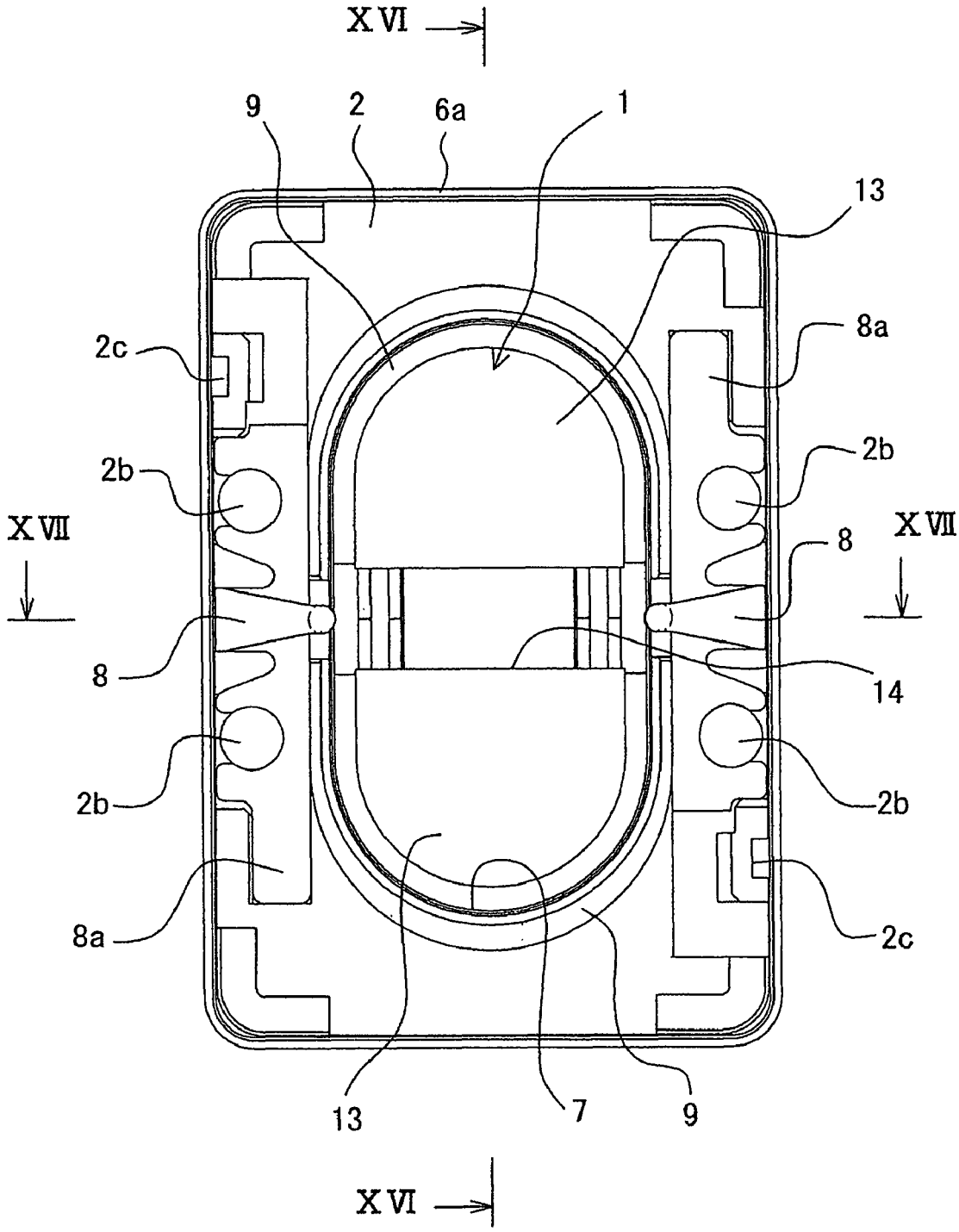
FIG. 15 is a bottom view of the speaker shown in FIG. 14.
Figure 16:
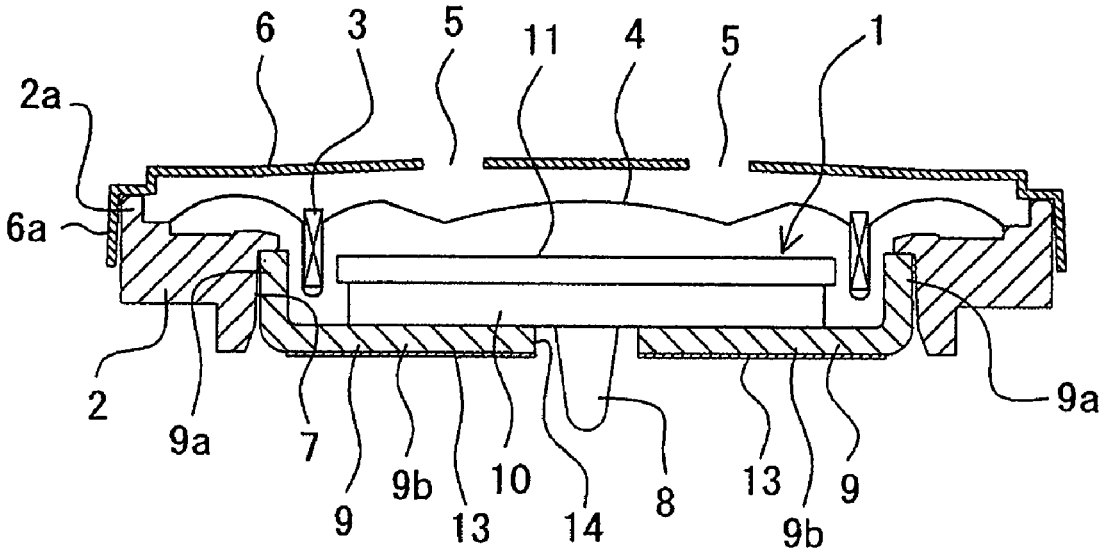
FIG. 16 is a cross-sectional view taken along a line XVI-XVI and viewed along arrows in FIG. 15.
Figure 17:
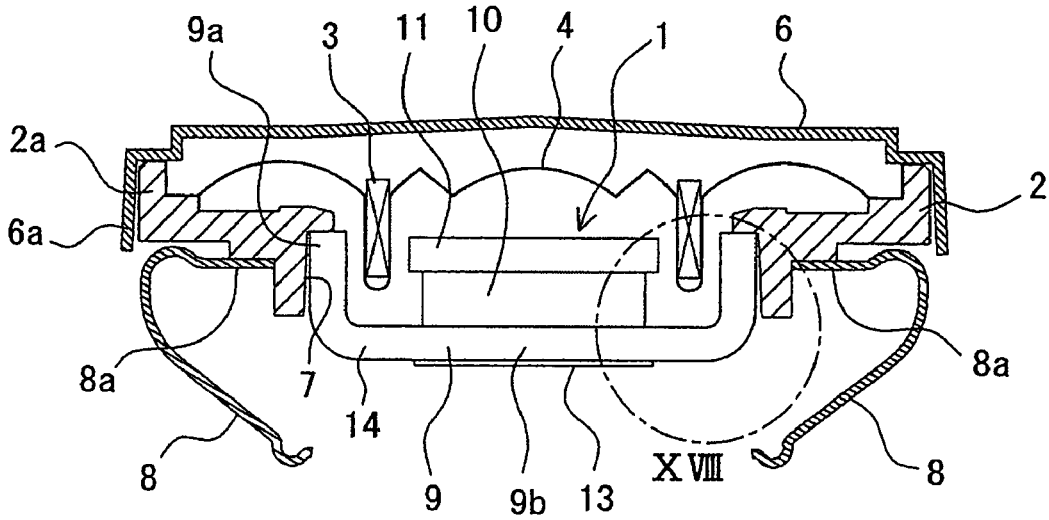
FIG. 17 is a cross-sectional view taken along a line XVII-XVII and viewed along arrows in FIG. 15.
Figure 18:
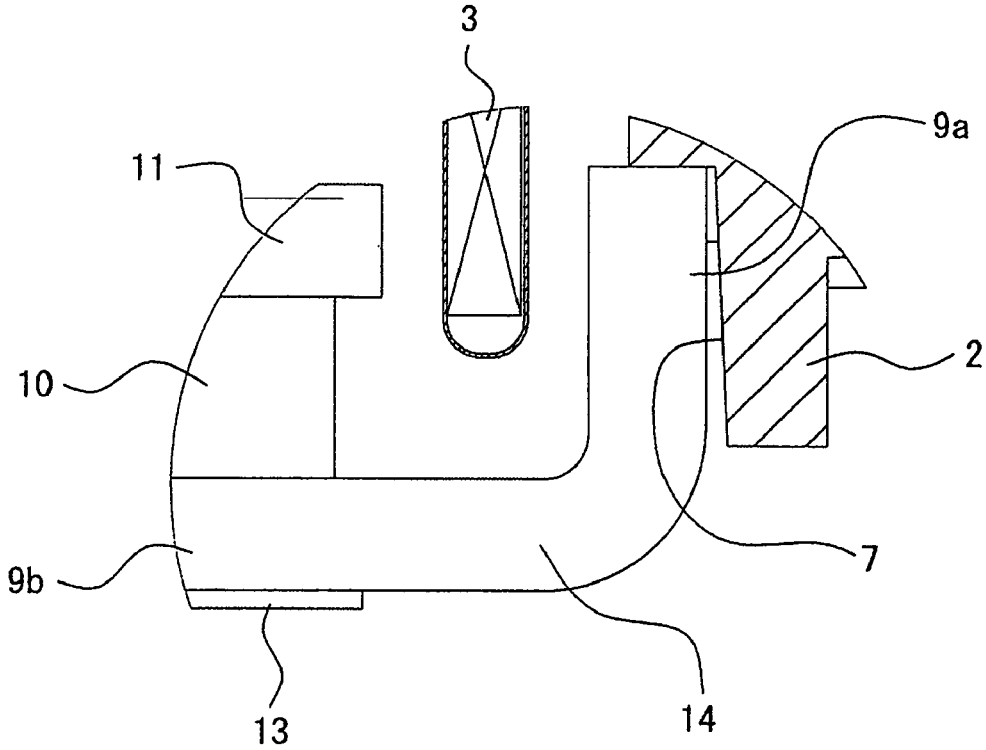
FIG. 18 is a cross-sectional view taken along a line XVIII-XVIII and viewed along arrows in FIG. 17.

As shown in FIGS. 11 to 13, a speaker of the Embodiment 2 is fabricated by injection-molding the frame 2 in a manner similar to a case of Embodiment 1. Unlike Embodiment 1, the frame 2 is formed by insert-molding. A yoke 9 and terminals

8 are integrated into a frame at a time of insert-molding. By this, it is possible to reduce a number of steps in assembling the speaker.

Tip end portions of the terminals 8 are retracted in a back pressure adjusting hole 14 of the yoke 9, and injected resin of the frame 2 is removed around a periphery of the back pressure adjusting hole 14. By this, the tip end portions of the terminals 8 can be closely in contact with a conductive pattern 15*a* of circuit board 15. In a case where for example contact between the terminal and the conductive pattern 15*a* is insufficient, it is possible to form, when necessary, the terminal 8 made of a spring material on a side of the conductive pattern 15*a* of the circuit substrate 15.

In this Embodiment 2, numerical references are attached to portions same as those of the Embodiment 1, and redundant explanation is omitted.

Embodiment 3

As shown in FIGS. 14 to 18, a speaker according to Embodiment 3 is different from that of Embodiment 1. A yoke 9 is divided into two parts, and a back pressure adjusting hole 14 is formed by a gap provided between the divided yokes. Since the yokes 9 are divided, it is possible to freely adjust size, shape and position of he back pressure adjusting hole 14. Further, it is possible to appropriately change size, shape and position of terminals 8. Further, the yoke can be easily machined.

In Embodiment 3, portions same as those of Embodiment 1 are designated by numerical references same as those in Embodiment 1, and redundant explanation is omitted.

The present invention is not confined to the configurations listed in the foregoing embodiments, but it is easily understood that the person skilled in the art can modify such configurations into various other modes, within the scope of the present invention described in the claims.

The entire disclosures of Japanese Patent Applications No. 2006-147972 filed on May 29, 2006 including the specification, claims, drawings and summary are incorporated herein by reference in its entirety.

What is claimed is:

1. A speaker comprising:

a frame with a yoke of a magnetic circuit portion embedded inside a central through hole;

a diaphragm having a voice coil inserted in a magnetic circuit of the magnetic circuit portion;

a cap having a sound dispersing hole that covers over the diaphragm and the frame; and a terminal electrically connected to the voice coil on a side opposite to the cap of the frame, wherein an insulating body is attached to an exposing portion of the yoke on the side opposite to the cap, a back pressure adjusting hole is provided in the exposing portion with respect to the diaphragm, and the terminals are provided to be retractable in the back pressure adjusting hole.

2. The speaker according to claim 1, wherein the terminal is made of a spring material enabling retraction of the terminal inside the back pressure adjusting hole.

3. The speaker according to claim 1, wherein the yoke is shaped to have an outline of rectangular with its corners rounded, and the back pressure adjusting hole is formed on a side of a minor axis of the yoke.

4. The speaker according to claim 1, wherein the frame is formed by injecting a resin, and the yoke and the terminal are integrated with the frame when the frame is formed.

5. The speaker according to claim 1, wherein the yoke includes a bottom plate in contact with the thorough hole of the frame on a side opposite to the cap and a protruding wall protruding from a periphery of the bottom plate and embedded in the through hole of frame, and the back pressure adjusting hole is formed to bridge the bottom plate of the yoke and the protruding wall.

6. The speaker according to claim 1, wherein the yoke is divided into a plurality of pieces, and the back pressure adjusting hole is formed by a gap provided between the divided pieces.

* * * * *

UNITED STATES PATENT AND TRADEMARK OFFICE

CERTIFICATE OF CORRECTION

PATENT NO. : 8,009,855 B2
APPLICATION NO. : 11/805795
DATED : August 30, 2011
INVENTOR(S) : Satoshi Chiba It is certified that error appears in the above-identified patent and that said Letters Patent is hereby corrected as shown below:

Title Page, Item (73) Assignee:

Two Assignees should have been listed on the Letters Patent Document As:

Assignee: Pioneer Corporation

Assignee: Tohoku Pioneer Corporation

Signed and Sealed this
Twenty-first Day of August, 2012

David J. Kappos

David J. Kappos
*Director of the United States Patent and Trademark Office*